US009907382B2

(12) United States Patent
Liu

(10) Patent No.: US 9,907,382 B2
(45) Date of Patent: Mar. 6, 2018

(54) SPRAY HEAD AND BODY CLEANING DEVICE

(71) Applicant: BOE TECHNOLOGY GROUP CO., LTD., Beijing (CN)

(72) Inventor: Xueqiang Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 103 days.

(21) Appl. No.: 14/646,281

(22) PCT Filed: Apr. 17, 2015

(86) PCT No.: PCT/CN2015/076844

§ 371 (c)(1),
(2) Date: May 20, 2015

(87) PCT Pub. No.: WO2016/050053

PCT Pub. Date: Apr. 7, 2016

(65) Prior Publication Data

US 2016/0174678 A1 Jun. 23, 2016

(30) Foreign Application Priority Data

Sep. 30, 2014 (CN) ..... 2014 2 0576114 U

(51) Int. Cl.
*A45D 19/02* (2006.01)
*A61H 7/00* (2006.01)
(Continued)

(52) U.S. Cl.
CPC ..... *A45D 19/02* (2013.01); *A61H 7/002* (2013.01); *A61H 7/003* (2013.01); *B05B 1/14* (2013.01);
(Continued)

(58) Field of Classification Search
CPC ..... A45D 19/02; A45D 2019/005; A45D 2019/0033; A61H 2205/021; A61H 33/6036
See application file for complete search history.

(56) References Cited

U.S. PATENT DOCUMENTS 655,816 A * 8/1900 Vogel ..... A45D 19/02 132/114
946,622 A * 1/1910 Thurman ..... A45D 19/02 132/114
(Continued)

FOREIGN PATENT DOCUMENTS

CN 2249048 Y 3/1997
CN 2545883 Y 4/2003
(Continued)

OTHER PUBLICATIONS

International Search Report of PCT/CN2015/076844 in Chinese, dated Jul. 17, 2015 with English translation.
(Continued)

*Primary Examiner* — J. Casimer Jacyna
(74) *Attorney, Agent, or Firm* — Collard & Roe, P.C.

(57) ABSTRACT

The embodiments of the present invention relate to a spray head and a body cleaning device, the spray head comprising: a spray head body comprising a panel provided with spray holes, the panel being provided with a plurality of brush rods, each of which forming a spheroid at an end portion thereof that faces away from the spray head body. The spheroid is made of an elastic material. The spray head, during its use, can penetrate through hair to thoroughly clean the scalp and the bottom portion of the hair near the scalp.

13 Claims, 2 Drawing Sheets

(51) Int. Cl.

| | |
|---|---|
| ***B05B 1/14*** | (2006.01) |
| *A61H 33/00* | (2006.01) |
| *A45D 19/00* | (2006.01) |

(52) U.S. Cl.

CPC ..... *A45D 2019/005* (2013.01); *A45D 2019/0033* (2013.01); *A61H 33/6036* (2013.01); *A61H 2205/021* (2013.01)

(56) References Cited

U.S. PATENT DOCUMENTS

2004/0244105 A1* 12/2004 Tsai ..... B05B 15/067 4/615
2005/0183736 A1* 8/2005 Wang ..... A45D 19/02 132/119.1
2010/0162479 A1 7/2010 Tai
2012/0121313 A1* 5/2012 Thiebaut ..... A61H 7/003 401/195
2013/0174860 A1* 7/2013 Takagi ..... A45D 19/02 132/200
2014/0261519 A1* 9/2014 Kodama ..... A45D 19/02 132/208
2015/0101630 A1* 4/2015 Kodama ..... A45D 19/02 132/200
2015/0282676 A1* 10/2015 Lee ..... A47K 3/28 4/518

FOREIGN PATENT DOCUMENTS

CN 2720876 Y 8/2005
CN 201132138 Y 10/2008
CN 102259069 A 11/2011
CN 202035638 U 11/2011

OTHER PUBLICATIONS

Notice of Transmittal of the International Search Report of PCT/CN2015/076844 in Chinese, dated Jul. 17, 2015.
Written Opinion of the International Searching Authority of PCT/CN2015/076844 in Chinese, dated Jul. 17, 2015 with translation English.

* cited by examiner

SPRAY HEAD AND BODY CLEANING DEVICE

CROSS REFERENCE TO RELATED APPLICATIONS

This application is the National Stage of PCT/CN2015/076844 filed on Apr. 17, 2015, which claims priority under 35 U.S.C. §119 of Chinese Application No. 201420576114.6 filed on Sep. 30, 2014, the disclosure of which is incorporated by reference.

TECHNICAL FIELD

The embodiments of the present invention relate to a spray head and a body cleaning device.

BACKGROUND

At present, domestic and foreign spray heads of body cleaning devices are incapable of thoroughly cleaning scalp, especially curly hair, in the course of their use.

SUMMARY

The embodiments of the present invention provide a spray head and a body cleaning device, where the spray head can penetrate through hair in the course of its use to thoroughly clean the hair and scalp.

To achieve the above object, the embodiments of the present invention provide the following technical solutions:

A spray head, comprising: a spray head body comprising a panel provided with spray holes, said panel being provided with a plurality of brush rods with spheroids formed at end portions of the brush rods that face away from the spray head body.

In one embodiment, the spheroid is made of an elastic material.

During use of the spray head of the embodiments of the present invention, the brush rods provided on the spray head body can penetrate through a user's hair and the spheroid formed at the end portion of each brush rod can contact the user's scalp, and clean and massage the user's scalp, where the brush rod can serve as a comb such that the water sprayed from the spray holes easily enter the hair to fully contact the hair and scalp, thereby thoroughly cleaning the hair, especially the scalp and the bottom portion of the hair near the scalp.

Therefore, the spray head of the embodiments of the present invention, during its use, can penetrate through hair to thoroughly clean the hair, the scalp, and the bottom portion of the hair near the scalp.

Besides, as the brush rod penetrate through hair, the spheroid formed at the end of each brush rod may contact a user's hair. The spheroid made of an elastic material can be deformed to ease the interaction between the scalp and the spray head. Meanwhile, the spherical structure may increase the force bearing surface of the scalp so as to alleviate the pressure produced on the scalp and result in a massaging effect on the scalp.

In one embodiment, the plurality of brush rods is uniformly distributed at edges of the panel.

In one embodiment, the separation distance between each two adjacent brush rods is 0.5 cm.

In one embodiment, the separation distance between each two adjacent brush rods is 1 cm; the spheroid has a diameter of 0.5 cm.

In one embodiment, the brush rod has a length of 1 cm.

In one embodiment, at least one brush rod has a water passage; the water inlet of the water passage is in communication with the chamber formed in the spray head body and the water outlet of the water passage is located on the surface of the spheroid. In one embodiment, the water outlet of the water passage is located on the surface of the spheroid in an extension line of the water passage.

In one embodiment, the brush rod and the spheroid formed at the end thereof are made of the same material.

In one embodiment, the spheroid is made of a silicone material.

In one embodiment, the silicone material is a phenylene silicone rubber; alternatively, the silicone material is a phenylene ether silicone rubber.

The embodiments of the present invention also provide a body cleaning device, comprising a spray head of any of the above technical solutions.

BRIEF DESCRIPTION OF THE DRAWINGS

In order to illustrate the technical solutions of the embodiments of the present invention more clearly, the figures of the embodiments are simply described below. Apparently, the figures described below merely relate to some embodiments of the present invention rather than are limitative of the present invention.

DETAILED DESCRIPTION

To make the object, technical solutions, and advantages of the present invention clearer, the technical solutions of the embodiments of the present invention will be described below in a clearer and more complete way with reference to the figures of the embodiments of the present invention. Apparently, the embodiments described are only part, rather than all of the embodiments of the present invention. Based on the embodiments of the present invention described, all the other embodiments obtained by a person of ordinary skills in the art without paying inventive work fall into the scope of protection of the present invention.

Figure 1:
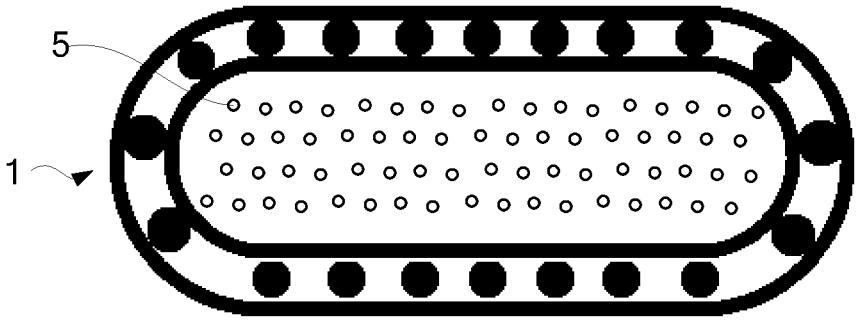
FIG. 1 is a schematic view of a bottom structure of a spray head provided in embodiments of the present invention.
Figure 2:
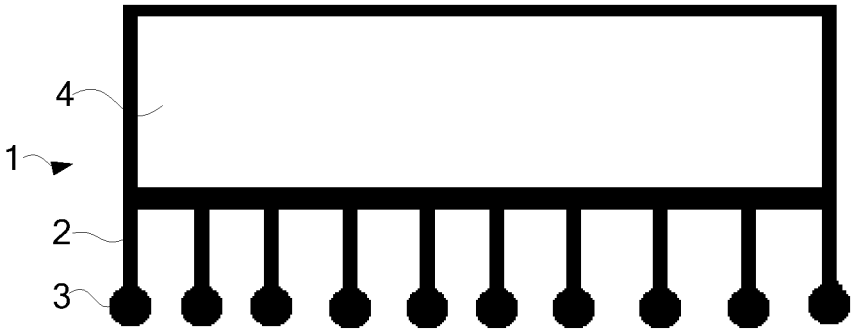
FIG. 2 is a side view of a spray head provided in embodiments of the present invention.
Figure 4:
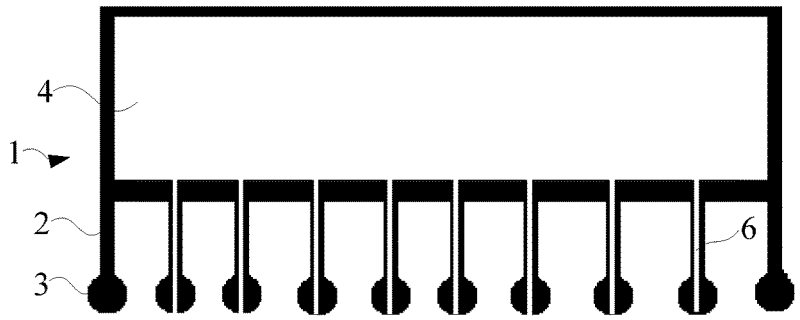
FIG. 4 is a longitudinal sectional schematic view of a spray head body in a spray head provided in embodiments of the present invention.

As illustrated in FIGS. 1, 2 and 4, the spray head provided by the embodiments of the present invention comprises: a spray head body 1 comprising a panel provided with spray holes 5, the panel being provided with a plurality of brush rods 2, a chamber 4 being formed in the spray head body 1, the chamber being in communication with the spray holes 5. Each brush rod 2 has a spheroid 3 at its end portion that faces away from the spray head body 1, and the spheroid 3 is made of an elastic material.

During use of the above spray head, the brush rods 2 provided on the spray head body 1 can penetrate through a user's hair and the spheroid 3 formed at the end portion of each brush rod 2 can contact the user's scalp, and clean and massage the user's scalp. In addition, the brush rod 2 can serve as a comb such that the water sprayed from the spray holes 5 easily enters the hair to fully contact the hair and the scalp, thereby thoroughly cleaning the hair, scalp, and the bottom portion of the hair near the scalp.

Therefore, the above spray head, in the course of its use, can penetrate through hair to thoroughly clean the hair, the scalp, and the bottom portion of the hair near the scalp.

In addition, as the brush rod 2 passes through the hair, the spheroid 3 formed at the end of each brush rod 2 can contact a user's scalp and the spheroid 3 made of the elastic material can be deformed to ease the interaction between the scalp and the spray head. Meanwhile, the spheroid 3 can increase the force bearing surface of the scalp so as to alleviate the pressure generated on the scalp and result in a massaging effect on the scalp.

As illustrated in FIG. 1, in one particular embodiment, a plurality of brush rods 2 is distributed uniformly at the edge of the panel, wherein spray holes 5 are provided in the spray head body 1.

As illustrated in FIG. 2, on the basis of the above embodiments, in one particular embodiment, each of the brush rods 2 has a length of 1 cm.

The brush rods 2 with a length of 1 cm can prevent the spray head body 1 from directly contacting the scalp to pressurize the user's scalp as the brush rods 2 penetrate through the hair.

As illustrated in FIG. 2, on the basis of the above embodiments, in a preferred embodiment, the separation distance between each two adjacent brush rods 2 is 0.5 cm; in another preferred embodiment, the separation distance between each two adjacent brush rods is 1 cm and the diameter of the spheroids 3 is 0.5 cm.

Figure 3:
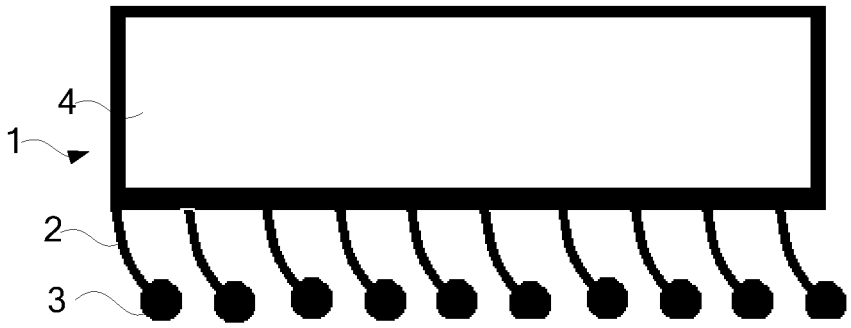
FIG. 3 is a schematic side view of a spray head body provided in embodiments of the present invention after applying force to the spray head.
Figure 5:
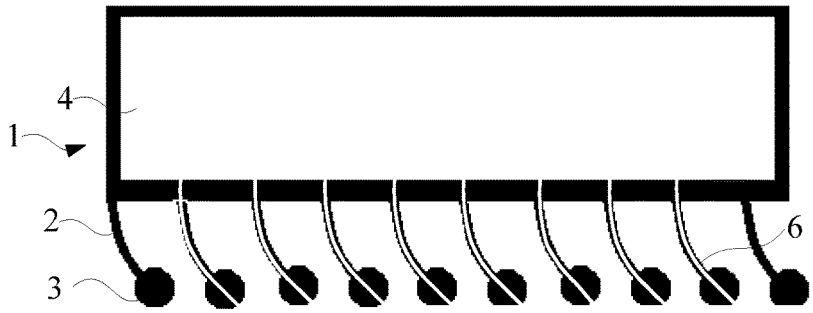
FIG. 5 is a longitudinal sectional schematic view of a spray head body provided in embodiments of the present invention after applying force to the spray head.

On the basis of the above embodiments, in one particular embodiment, the brush rods 2 and the spheroids 3 formed at their end portions are made of the same material, i.e. an elastic material; more preferably, the brush rods 2 and the spheroids formed at their end portions are prepared by a one-piece fabrication process. As illustrated in FIG. 3 and FIG. 5, as the brush rods 2 penetrate through the user's hair and the spheroids 3 at their end portions contact the scalp, the brush rods 2 will be deformed to ease the interaction between the scalp and the spray head, thereby alleviating the pressure produced on user's scalp.

On the basis of each of the above-described embodiments, in one particular embodiment, the elastic material may be a silicone material.

In a preferred embodiment, the silicone material is a phenylene silicone rubber.

Phenylene silicone rubber is a class of silicone rubber formed by introduction of phenylene groups to the polysiloxane backbone. Phenylene silicone rubber exhibits excellent resistance to high temperature and resistance to radiation, capable of resisting a high temperature of up to 250 to 300° C., and has good characteristics such as dielectric properties, moisture resistance, mildew resistance and steam resistance. In the raw rubber composition of the phenylene silicone rubber, it is appropriate when the phenylene content is 60%, the phenyl content is 30%, and the methyl content is 10% (the vinyl content is 0.6%). In this case, the vulcanized rubber exhibits excellent overall performance.

In another preferred embodiment, the silicone material is a phenylene ether silicone rubber.

Phenylene ether silicone rubber is a polysiloxane to whose molecular main chain phenyl ether groups and phenylene groups are introduced. Phenyl ether silicone rubber has good mechanical properties, with its tensile strength generally up to 150 to 180 kg/cm$^2$, i.e. 14.7 to 17.7 Mpa, which is far greater than the strength of vinyl silicone rubber, and an excellent resistance to radiation which is better than that of phenylene silicone rubber. Phenyl ether silicone rubber can be resistant to hot air aging at 250° C. over a long period of time and has high strength even after ageing. Phenylene ether silicone rubber has low temperature performance far superior to phenylene silicone rubber, and has good processing performance useful for manufacturing model articles and extruded products under specific requirements.

As illustrated in FIG. 4 and FIG. 5, on the basis of each of the above-described embodiments, in a specific embodiment, at least part of the brush rods in the plurality of brush rods 2 has a water passage 6; the water inlet of the water passage 6 is in communication with the chamber formed in the spray head body 1 and the water outlet of the water passage 6 is located on the surface of the spheroid 3. Such a design can reduce water sputtering, and without hair barrier, the water flows from the water passage and directly arrives at the scalp surface for cleaning. In a specific embodiment, the water outlet of the water passage is located on the surface of the spheroid in an extension line of the water passage. When the water outlet is located on the surface of the spheroid in the extension line of the water passage, the brush rod will be slightly inclined during use of the spray head, and the water outlet is located near the portion of the spheroid that contacts the scalp, the water flowed from the spheroid can effectively and timely clean the scalp and the bottom portion of the hair near the scalp.

The embodiments of the present invention further provide a body cleaning device, comprising a spray head provided by any of the above technical solutions.

Figure 6:
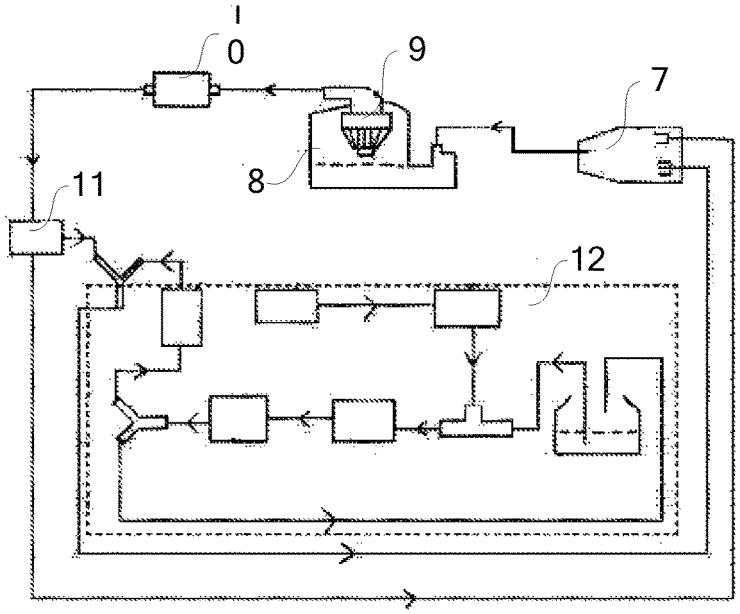
FIG. 6 is a schematic view of a body cleaning device provided in embodiments of the present invention.

As illustrated in FIG. 6, the above body cleaning device comprises a urine cup 7 connected to a sewage tank 8 provided with a separator 9 thereabove, the separator 9 being connected to the input terminal of a suction motor 10 whose output terminal is connected to a filter 11, one outlet of the filter 11 being connected to the urine cup 7; the other outlet of the filter 11 is connected to one inlet of a manifold and the other inlet of the manifold is connected to the outlet of a hot water system 12; the outlet of the manifold is connected to the urine cup 7. However, the above spray head is connected to the interface part of the water inlet of the urine cup 7.

The present invention includes the following embodiments:

Embodiment 1

A spray head, comprising:

a spray head body having a panel provided with spray holes, the panel being provided with a plurality of brush rods, each of the brush rods being formed with a spheroid at its end facing away from the spray head body.

Embodiment 2

The spray head according to Embodiment 1, wherein the spheroids is made of an elastic material.

Embodiment 3

The spray head according to Embodiment 1 or 2, wherein a chamber is formed in the spray head body, the chamber being in communication with the spray hole.

Embodiment 4

The spray head according to any of the preceding embodiments, wherein a separation distance between each two adjacent brush rods is from 0.4 cm to 1.4 cm.

Embodiment 5

The spray head according to any of the preceding embodiments, wherein the separation distance between each two adjacent brush rods is from 0.6 cm to 1.2 cm; a diameter of the spheroid is from 0.4 to 0.5 times the separation distance between the brush rods.

Embodiment 6

The spray head according to any of the preceding embodiments, wherein the brush rods each have a length of from 0.8 cm to 1.0 cm.

Embodiment 7

The spray head according to any of the preceding embodiments, wherein the plurality of brush rods is distributed uniformly on the edges of the panel.

Embodiment 8

The spray head according to any of the preceding embodiments, wherein the separation distance between two adjacent brush rods is 0.5 cm.

Embodiment 9

The spray head according to any of Embodiments 1 to 7, wherein the separation distance between the two adjacent brush rods is 1 cm; the diameter of the spheroids is 0.5 cm.

Embodiment 10

The spray head according to any of the preceding embodiments, wherein the length of the brush rods is 1 cm.

Embodiment 11

The spray head according to any of the preceding embodiments, wherein at least one of the brush rods has a water passage; a water inlet of the water passage is in communication with the chamber formed in the spray head body and a water outlet of the water passage is located on a surface of the spheroid.

Embodiment 12

The spray head according to Embodiment 11, wherein the water outlet of the water passage is located on the surface of the spheroid in an extension line of the water passage. When the water outlet is located on the surface of the spheroid in the extension line of the water passage, the brush rods will be slightly inclined during use of the spray head, and the water outlet is located near the portion of the spheroid that contacts the scalp, the water flowed from the spheroid can effectively and timely clean the scalp and the bottom portion of the hair near the scalp.

Embodiment 13

The spray head according to any of the preceding embodiments, wherein each of the brush rods and the spheroids formed at its end are made of a same material.

Embodiment 14

The spray head according to any of the preceding embodiments, wherein the spheroid is made of a silicone material.

Embodiment 15

The spray head according to any of the preceding embodiments, wherein the silicone material is a phenylene silicone rubber or phenylene ether silicone rubber.

Embodiment 16

A body cleaning device comprising a spray head according to any of Embodiments 1 to 15.

The above are merely exemplary embodiments of the present invention, and are not intended to limit the scope of protection of the present invention, which is determined by the appended claims.

The present application claims the priority of the Chinese Patent Application No. 201,420,576,114.6 submitted on Sep. 30, 2014, and the content disclosed in the above Chinese patent application is incorporated by reference as part of this application.

The invention claimed is:

1. A spray head, comprising:

a spray head body having a panel provided with a plurality of spray holes, wherein the panel being provided with a plurality of brush rods, each of the brush rods being formed with a spheroid at its end facing away from the spray head body, the panel comprises a continuous first region and a second region surrounding the first region, the first region is provided with the spray holes, the second region is provided with the brush rods, the spray holes are configured to directly drain liquid outside the spray head body, and a chamber formed in the spray head body, the chamber being in communication with the spray hole, wherein at least one of the brush rods has a water passage;

the water passage passes through the spheroid, a water inlet of the water passage is in communication with the chamber formed in the spray head body and a water outlet of the water passage is located on a surface of the spheroid, the spray holes are uniformly distributed in the first region, and the spheroid is a phenylene silicone rubber or phenylene ether silicone rubber material.

2. The spray head according to claim 1, wherein the spheroid is made of an elastic material.

3. The spray head according to claim 1, wherein a separation distance between each two adjacent brush rods is from 0.4 cm to 1.4 cm.

4. The spray head according to claim 3, wherein the separation distance between each two adjacent brush rods is from 0.6 cm to 1.2 cm; a diameter of the spheroid is from 0.4 to 0.5 times the separation distance between the brush rods.

5. The spray head according to claim 1, wherein the brush rods each have a length of from 0.8 cm to 1.0 cm.

6. The spray head according to claim 1, wherein the plurality of brush rods is distributed uniformly on an edge of the panel.

7. The spray head according to claim 3, wherein the separation distance between two adjacent brush rods is 0.5 cm.

8. The spray head according to claim 3, wherein the separation distance between two adjacent brush rods is 1 cm; the diameter of the spheroid is 0.5 cm.

9. The spray head according to claim 5, wherein the length of the brush rods is 1 cm.

10. The spray head according to claim 1, wherein the water outlet of the water passage is located on the surface of the spheroid in an extension line of the water passage.

11. The spray head according to claim 1, wherein each of the brush rods and the spheroid formed at its end are made of a same material.

12. A body cleaning device comprising a spray head according to claim 1.

13. The spray head according to claim 1, wherein at least one of the brush rods is solid.

* * * * *